US006613724B2

(12) United States Patent
Strickland et al.

(10) Patent No.: US 6,613,724 B2
(45) Date of Patent: Sep. 2, 2003

(54) GAS-FUELLED ENGINE LUBRICATING OIL COMPOSITIONS

(75) Inventors: Keith Strickland, Oxfordshire (GB); Laurent Chambard, Oxfordshire (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/163,100

(22) Filed: Jun. 5, 2002

(65) Prior Publication Data

US 2003/0004070 A1 Jan. 2, 2003

(30) Foreign Application Priority Data

Jun. 15, 2001 (EP) ..... 01305232

(51) Int. Cl.[7] ..... C10M 129/54
(52) U.S. Cl. ..... 508/460
(58) Field of Search ..... 508/460

(56) References Cited

U.S. PATENT DOCUMENTS 3,798,163 A 3/1974 Palmer ..... 252/33.4
5,525,247 A * 6/1996 Miyaji et al. ..... 508/192
6,034,039 A * 3/2000 Gomes et al. ..... 508/331
6,103,672 A * 8/2000 Dunn et al. ..... 508/185
6,140,282 A 10/2000 Cartwright et al. ..... 508/398
6,159,911 A * 12/2000 Katafuchi ..... 508/391
6,162,769 A * 12/2000 Polhaar et al. ..... 508/339

FOREIGN PATENT DOCUMENTS

EP 0 816 447 A1 7/1998 ..... C10M/139/00

* cited by examiner

*Primary Examiner*—Jacqueline V. Howard

(57) ABSTRACT

A gas-fuelled engine lubricating oil composition that is substantially free from anti-oxidant additives. The gas-fuelled engine lubricating oil composition exhibits good resistance to oil oxidation and nitration and improved corrosion resistance. The composition includes:

(i) an oil of lubricating viscosity;

(ii) a detergent composition including at least one calcium salicylate having a TBN in the range from 70 to 245;

(iii) 0 to 0.2 mass % of nitrogen, based on the mass of the oil composition, of a dispersant; and (iv) a minor amount of one or more co-additives.

14 Claims, No Drawings

GAS-FUELLED ENGINE LUBRICATING OIL COMPOSITIONS

This invention relates to gas-fuelled engine lubricating oil compositions. Gas-fuelled engines can, for example, be found in mobile and stationary power sources.

Gas-fuelled engines, sometimes referred to as gas-fired engines or merely gas engines, are known and may be used in the oil and gas industry, for example, to drive pumping stations of natural gas pipelines, blowers and generators in purification plants and on gas tankers; and to compress natural gas at well heads and along pipe lines. Gas-fuelled engines also find application in motor vehicles, such as in passenger motor cars and in heavy-duty trucks, where the fuel is in the form of liquid petroleum gas or compressed natural gas. They are also used in electric power generation plants, particularly when they are also equipped with heat recovery systems.

The design of the gas-fuelled engines may be two- or four-stroke, spark-ignited or compression-ignited, though four-stroke compression-ignited designs constitute a large percentage. Natural gas constitutes a typical fuel.

The engines generally run continuously near full load conditions, shutting down only for maintenance, such as for oil changes. This condition of running continuously places severe demands on the lubricating oil composition, for example, the oil oxidation and nitration processes often limit the life of the lubricating oil composition. Therefore, it is desirable for gas-fuelled lubricating oil compositions to have long life through good resistance to oil oxidation and nitration.

U.S. Pat. No. 6,140,282 discloses a lubricating oil composition for gas engines comprising a major amount of oil and a minor amount of a mixture of a 64 TBN neutral calcium salicylate and a calcium sulfonate and/or phenate detergent. The examples either explicitly include an anti-oxidant or they include an additive system that includes an anti-oxidant.

JP-B-2970991 discloses oil compositions for gas engines, comprising base oil, an alkaline earth metal salicylate having base number of 175 to 300 mgKOH/g, a dispersant, a zinc dithiophosphate and an anti-oxidant selected from: a mixture of phenolic- and aminic-type compounds, di-t-butyl p-cresol, diphenylamine and a polymeric hindered phenol compound.

The aim of the present invention is to provide improved gas-fuelled lubricating oil compositions. In particular, the aim of the present invention is to provide gas-fuelled lubricating oil compositions exhibiting good performance towards oil oxidation and nitration processes, so that the interval between an oil change can be extended, and improved anti-corrosion properties.

Applicant has found a defined gas-fuelled lubricating oil composition that provides good resistance to oil oxidation and nitration processes and improved anti-corrosion properties.

Accordingly, a first aspect of the present invention is a gas-fuelled engine lubricating oil composition having a sulfated ash content according to ASTM D-874 of 0.01 to 1.3%, which comprises or is made by admixing:

(i) a major amount of oil of lubricating viscosity;

(ii) a minor amount of a detergent composition comprising at least one calcium salicylate having a TBN in the range from 70 to 245 according to ASTM D-2896, preferably in the range from 95 to 195;

(iii) 0 to 0.2 mass % of nitrogen, based on the mass of the oil composition, of a dispersant; and (iv) a minor amount of one or more co-additives;

with the proviso that the oil composition is substantially free from an anti-oxidant additive.

In a second aspect, the present invention provides use of the gas-fuelled engine lubricating oil composition defined in the first aspect to reduce viscosity increase and minimize acidity increase.

In a third aspect, the present invention provides use of the gas-fuelled engine lubricating oil composition defined in the first aspect to provide resistance to oxidation and nitration processes.

In a fourth aspect, the present invention provides use of the gas-fuelled engine lubricating oil composition to improve corrosion resistance.

In a fifth aspect, the present invention provides a method of lubricating a gas-fuelled engine, which method comprises supplying a lubricating oil composition of the first aspect to the engine.

In a sixth aspect, the present invention provides a concentrate for a gas-fuelled engine lubricating oil composition, the concentrate being substantially free from an anti-oxidant additive and comprising:

(ii) more than 40 mass %, preferably a major amount, of a detergent composition comprising at least one calcium salicylate having a TBN in the range from 70 to 245 according to ASTM D-2896, preferably in the range from 95 to 195;

(iii) 0 to 0.5 mass % of nitrogen, based on the mass of the oil composition, of a dispersant; and (iv) a minor amount of one or more co-additives.

The lubricating oil compositions according to the first aspect have been found to be effective in lubricating gas-fuelled engines in heavy-duty trucks, pumping stations of natural gas pipelines, and stationary power sources.

The acidity of the lubricating oil composition is determined by ASTM D-664.

"Major amount" means in excess of 50 mass % of the composition, preferably in excess of 60 mass % of the composition, more preferably in excess of 70 mass % of the composition, and most preferably in excess of 80 mass % of the composition.

"Minor amount" means less than 50 mass % of the composition, preferably less than 40 mass %, more preferably less than 30 mass % and most preferably less than 20 mass %, both in respect of the stated additive and in respect of the total mass % of all the additives present in composition, reckoned as active ingredient of the additive or additives.

"Comprises or comprising" or a cognate word is taken to specify the presence of the stated features, steps, integers or components, but does not preclude the presence or addition of one or more other features, steps, integer components or groups thereof.

"Consists essentially or consisting essentially" or a cognate word is taken to specify the presence of the stated features, steps, integers or components, but does not preclude the presence or addition of one or more other features, steps, integer components or groups thereof provided their inclusion does not substantially affect the present invention.

"Consists or consisting" or a cognate word is taken to specify the presence of the stated features, steps, integers or components and no other features, steps, integers or components.

"Substantially free from an anti-oxidant additive" means 0.25 or less, preferably 0.1 or less, more preferably 0.05 or less, mass %, based on active ingredient, of anti-oxidant, based on the mass of the oil composition.

Unless otherwise started, all proportions are expressed as mass % active ingredient, i.e. as if solvent or diluent or other inert material was absent.

The features of the present invention will now be discussed in more detail.

Lubricating Oil Composition

Gas-fuelled engine lubricating oil compositions of the present invention preferably have from 0.01 to 1, more preferably from 0.01 to 0.5, even more preferably from 0.1 to 0.5, % of sulfated ash, as measured according to ASTM D874.

Preferably, the gas-fuelled engine lubricating oil compositions of the present invention have a total base number (TBN), as measured according to ASTM D-2896, in the range from 2 to 20, preferably 2 to 12. Gas-fuelled engine lubricating oil compositions, which have a TBN in the range from 2 to 10 are especially preferred, advantageously the TBN is in the range from 2 to 7, more advantageously from 4 to 7.

In a preferred embodiment of the present invention, the gas-fuelled engine lubricating oil composition has from 0.0 to 0.1 mass % of phosphorus, based on the mass of the oil composition. The oil composition especially has less than 0.8, more preferably less than 0.05, preferably in the range from 0.02 to 0.03, mass % of phosphorus. The amount of phosphorus is measured according to method to ASTM D-5185.

Applicant has found that the gas-fuelled engine lubricating oil composition of the present invention is effective in controlling viscosity and acidity increase through its resistance to oxidation and nitration processes. This is especially surprising because the oil composition is substantially free from an anti-oxidant additive. It is noted that the scope of the present invention extends to gas-fuelled engine lubricating oil compositions including an anti-oxidant additive in an amount insufficient to demonstrate its anti-oxidant effect, such an amount can be up to 0.25, preferably up to 0.1, for example 0.05 or less, mass %, based on active ingredient of anti-oxidant, based on the mass of the oil composition. The gas-fuelled engine lubricating oil composition is preferably free from anti-oxidant.

Anti-oxidants or oxidation inhibitors reduce the tendency of mineral oils to deteriorate in service, evidence of such deterioration being, for example, the production of varnish-like deposits on metal surfaces and of sludge, and viscosity increase. Formulators of gas-fuelled engine lubricating oil compositions have always considered anti-oxidants to be an important requirement in order to achieve good resistance to oxidation.

Examples of anti-oxidants include phenolic, such as hindered substituted-phenols; amines, such as diphenylamines; sulfur-containing compounds, such as sulfurised phenols and derivatives thereof; and metal-containing compounds, such as molybdenum and copper compounds, for example molybdenum and copper dithiocarbamates.

Oil of Lubricating Viscosity

The oil of lubricating viscosity (sometimes referred to as lubricating oil) may be any oil suitable for the lubrication of a gas-fuelled engine.

The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which include diesters such as di-octyl adipate, di-octyl sebacate and tridecyl adipate, or polymeric hydrocarbon lubricating oils, for example liquid polyisobutene and poly-alpha olefins. Commonly, a mineral oil is employed, such as Group I or Group II, as defined in API 1509 "Engine Oil Licensing and Certification System" Fourteenth Edition, December 1996.

The lubricating oil may generally be used in a proportion greater than 60, typically greater than 70, for example at least 80, mass %, based on the mass of the oil composition. The oil typically has a kinematic viscosity at 100° C. of from 2 to 40, for example for 3 to 15, $mm^2s^{-1}$ and a viscosity index of from 80 to 100, for example from 90 to 95.

Another class of lubricating oil is hydrocracked oils, where the refining process further breaks down the middle and heavy distillate fractions in the presence of hydrogen at high temperatures and moderate pressures. Hydrocracked oil typically has a kinematic viscosity at 100° C. of from 2 to 40, for example from 3 to 15, $mm^2s^{-1}$ and a viscosity index typically in the range of from 100 to 110, for example from 105 to 108.

The oil may include 'brightstock', which refers to base oils which are solvent-extracted, de-asphalted products from vacuum residuum generally having a kinematic viscosity at 100° C. of from 28 to 36 mm and are typically used in a proportion less than 30, preferably less than 20, more preferably less than 15, most preferably less than 10, such as less than 5, mass %, based on the mass of the oil composition.

Detergent Composition

A detergent is an additive that reduces formation of piston deposits, for example high-temperature varnish and lacquer deposits, in engines; it has acid-neutralising properties and is capable of keeping finely divided solids in suspension. It is based on metal "soaps", that is metal salts of organic acids, sometimes referred to as surfactants.

A detergent comprises a polar head, i.e. the metal salt of the organic acid, with a long hydrophobic tail for oil solubility. Therefore, organic acids typically have one or more functional groups, such as OH, COOH or $SO_3H$; and a hydrocarbyl substituent.

Examples of organic acids include sulphonic acids, phenols and sulphurised derivatives thereof, carboxylic acid and salicylic acids; examples of surfactants include metal salts thereof.

The detergent includes at least one calcium salicylate having a TBN in the range from 70 to 245 according to ASTM D-2896, preferably in the range from 95 to 195.

The detergent may also include other detergents such as, for example, metal sulfonates, metal phenates, metal carboxylates and metal salicylates other than that defined in the first aspect. Preferably, the detergent composition consists of calcium salts, such as calcium sulfonates, calcium phenates, caclium carboxylates and calcium salicylates other than that defined in the first aspect. The other detergents may be present in an amount, for example up to 10, such as less than 5 or less than 2, mass % of metal, based on the mass of total metal derived from the detergent composition.

In a preferred embodiment, the detergent composition consists of at least one calcium salicylate having a TBN in the range from 70 to 245.

The calcium salicylate may be sulphurised. Processes for sulfurizing, for example, processes for sulfurizing a hydrocarbyl-substituted salicylic acid or metal salicylate, are well known to those skilled in the art.

Preferred substituents in salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil-solubility.

Preferably, the calcium salicylate has a TBN in the range from 95 to 195, more preferably from 105 to 190, especially from 115 to 175, such as in the range from 140 to 175. TBN is measured according to ASTM D-2896.

The calcium salicylate of the present invention may be a salt of salicylic acid alone, or a salt of salicylic acid and one or more other organic acids, for example sulfonic acid and/or phenol. Salts of more than one type of organic acid are known as hybrid or complex detergents.

In the instance where the calcium salicylate is a salt of salicylic acid and one or more other organic acids, it is preferred that a major proportion of salicylic acid is present, based on the total moles of organic acids, for example at least 60 or 70, especially at least 80, such as 90 or more, mole % of salicylic acid, based on the total moles of organic acids in the detergent composition.

Preferably, the calcium salicylate is a salt of salicylic acid or a derivative thereof.

It will be appreciated by one skilled in the art that a single type of organic acid may contain a mixture of organic acids of the same type. For example, a sulphonic acid may contain a mixture of sulphonic acids of varying molecular weights. Such an organic acid composition is considered as one type.

For the avoidance of doubt, the detergent composition may also contain ashless detergents, i.e. non-metal containing detergents.

The detergent composition is present in the gas-fuelled lubricating oil composition in such an amount that the gas-fuelled lubricating oil composition has from 0.01 to 1.3% of sulfated ash. In the instance where the detergent composition consists of calcium salts, the amount of the detergent composition, based on calcium metal, is in the range from 0.003 to 0.39 mass %, based on the mass of the oil composition. Preferably, the detergent composition is present in a range from 0.003 to 0.30, more preferably in the range from 0.003 to 0.25, especially from 0.03 to 0.20, such as from 0.03 to 0.15, mass % of calcium, based on the mass of the oil composition.

Dispersant

A dispersant is an additive for a lubricating composition whose primary function is to hold solid and liquid contaminants in suspension, thereby passivating them and reducing engine deposits at the same time as reducing sludge depositions. Thus, for example, a dispersant maintains in suspension oil-insoluble substances that result from oxidation during use of the lubricating oil, thus preventing sludge flocculation and precipitation or deposition on metal parts of the engine.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, for example, polyisobutene succinic anhydride:polyamine condensation products which may be borated or unborated.

Preferably, the hydrocarbon backbone of dispersants suitable in the present invention has a number average molecular weight ($\overline{M}n$) of 400 to 3000, more preferably from 700 to 2500, especially from 900 to 2300.

Preferred dispersants for use in the present invention include a polyisobutenyl succinimide dispersant wherein the Mn of the polyisobutenyl groups is from 700 to 3000, such as 900 to 1200 or 2000 to 2300, or a borated derivative thereof which contains not more than 0.2, such as not more than 0.1, for example 0.01 to 0.1, mass % boron, as elemental boron. Advantageously, the dispersant is boron-free.

In a preferred embodiment, the amount of dispersant, based on nitrogen, is from 0.001 to 0.20, more preferably 0.002 to 0.18, such as from 0.05 to 0.16, mass %, based on the mass of the oil composition.

Other Co-Additives

Co-additives suitable in the present invention include viscosity index improvers, anti-wear agents, pour point depressants, rust inhibitors, corrosion inhibitors and anti-foaming agents.

Viscosity index improvers (or viscosity modifiers) impart high and low temperature operability to a lubricating oil and permit it to remain shear stable at elevated temperatures and also exhibit acceptable viscosity or fluidity at low temperatures. Suitable compounds for use as viscosity modifiers are generally high molecular weight hydrocarbon polymers, including polyesters, and viscosity index improver dispersants, which function as dispersants as well as viscosity index improvers. Oil-soluble viscosity modifying polymers generally have weight average molecular weights of from about 10,000 to 1,000,000, preferably 20,000 to 500,000, as determined by gel permeation chromatography or light scattering methods.

Antiwear agents, as their name implies, reduce wear of metal parts. Zinc dihydrocarbyl dithiophosphates (ZDDPs) are very widely used as antiwear agents. Examples of ZDDPs for use in oil-based compositions are those of the formula $Zn[SP(S)(OR^1)(OR^2)]_2$ wherein $R^1$ and $R^2$ contain from 1 to 18, and preferably 2 to 12, carbon atoms. Metal-containing compounds, such as molybdenum dithiocarbamate and dithiophosphate compounds, are also examples of anti-wear additives. Especially suitable in the present invention are ashless phosphorus- and sulfur-containing anti-wear compounds, for example sulfurised fatty acid esters.

Pour point depressants, otherwise known as lube oil flow improvers, lower the minimum temperature at which the fluid will flow or can be poured. Such additives are well known.

Foam control may be provided by an anti-foamant of the polysiloxane type, for example, silicone oil or polydimethyl siloxane.

Rust inhibitors selected from the group consisting of nonionic polyoxyalkylene polyols and esters thereof, polyoxyalkylene phenols, and anionic alkyl sulfonic acids maybe used.

Copper- and lead-bearing corrosion inhibitors may be used. Typically such compounds are the thiadiazole polysulfides containing from 5 to 50 carbon atoms, their derivatives and polymers thereof. Other additives are the thio and polythio sulfenamides of thiadiazoles. Benzotriazoles derivatives also fall within this class of additives. When these compounds are included in the lubricating composition, they are preferably present in an amount not exceeding 0.2 mass %.

Some of the above-mentioned additives may provide a multiplicity of effects; thus for example, a single additive may provide anti-wear and friction modifying performance, such as molybdenum compounds. This approach is well known and need not be further elaborated herein.

When lubricating oil compositions contain one or more of the above-mentioned additives, each additive has typically been blended into the base oil in an amount that enables the additive to provide its desired function. Representative effective amounts of such additives, when used in gas-fuelled lubricating oil compositions, are listed below. All the values listed are stated as mass percent active ingredient.

| | MASS % (Broad) | MASS % (Preferred) |
|---|---|---|
| Viscosity Modifier | 0 to 2.0 | 0. to 1.5 |
| Anti-wear Agent | 0 to 2.0 | 0 to 1.5 |
| Corrosion Inhibitor | 0 to 0.2 | 0 to 0.1 |
| Pour Point Depressant | 0 to 2 | 0.0 to 1.0 |
| Anti-Foaming Agent | 0 to 0.005 | 0 to 0.004 |
| Mineral or Synthetic Base Oil | Balance | Balance |

Mass % active ingredient based on the final lubricating oil composition.

In a preferred embodiment of the present invention, the gas-fuelled lubricating oil composition is substantially free of zinc compounds; more preferably, the lubricating oil composition comprises an ashless, i.e. non-metallic, anti-wear additive.

Preferably the lubricating oil composition according to the present invention comprises a major amount of oil of lubricating viscosity; a minor amount of a detergent composition as defined in the first aspect; 0 to 0.2 mass % of nitrogen, based on the mass of the oil composition, of a dispersant; a minor amount of an ashless anti-wear additive; and a minor amount of a corrosion inhibitor; the composition being substantially free from an anti-oxidant additive.

Concentrates

It may be desirable, although not essential, to prepare one or more additive packages or concentrates comprising the additives, whereby the additives can be added simultaneously to the oil of lubricating viscosity to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant.

Thus, the additives may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive packages(s), the remainder being base oil.

The term 'active ingredient' (a.i.) as used herein refers to the additive material that is not diluent, for example solvent or base oil.

The term 'oil-soluble' or 'oil-dispersible' as used herein does not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined individual (i.e. separate) additives that may or may not remain the same chemically before and after mixing, and thus the scope of the present invention extends to cases where the additives remain the same chemically before and after mixing and to cases where the additives do not remain the same chemically after mixing.

EXAMPLES

The present invention is illustrated by, but in no way limited to, the following examples.

Example 1 is a gas-fuelled engine lubricating oil composition of the invention, which was prepared by blending methods known in the art. The composition contains:

| COMPONENTS | Example 1 |
|---|---|
| Calcium salicylate (TBN 168) | 2.45 |
| Succinimide, a dispersant | 3.69 |
| Substituted benzotriazole, a passivator | 0.01 |
| A sulfurised fatty ester, an anti-wear additive | 0.5 |
| Group I basestock | Balance |
| TBN, ASTM D-2896 | 6.03 |
| Sulfated ash | 0.50 |

The above figures represent mass % of the additive component, i.e. includes diluent or solvent.

Examples A and B are commercially available gas-fuelled engine lubricating oils. Example A comprises OLOA1255, a widely used gas-fuelled engine oil additive package, which has at least one anti-oxidant and has a detergent composition based on phenate technology (i.e. no salicylate). Example A has a TBN of 5.2 and 0.45% of sulfated ash and Example B has a TBN of 6.6 and 0.50% of sulfated ash.

Examples 1, A and B were each tested according to the GFC T-021-A-90 procedure, an industry standard. The test assesses the oils for their resistance to oxidation and nitration. Each sample is placed in a bath maintained at 170° C. and air is bubbled through the sample at a constant flow rate for a period of 216 hours.

The following analysis was carried out on each sample at the start of the test (0 hour), 144 hours and after the test (216 hours):

kinematic viscosity at 100° C. (ASTM D445)

TAN (ASTM D664)

Infra-Red Oxidation and Nitration (spectroscopic method known in the art)

Insolubles (%)

The results of the GFC T-021-A-90 test are summarised in the table below:

| Example | Example 1 | Comparative Example A (commercial) | Comparative Example B (commercial) |
|---|---|---|---|
| Results after 144 hours | | | |
| Viscosity increase (%) | 14.1 | 70.4 | 73.8 |
| TAN increase (mgKOH/g) | 2.2 | 5.2 | 8.2 |
| IR oxidation (A/cm) | 40.3 | 54.4 | 49.2 |
| IR nitration (A/cm) | 4.7 | 20.6 | 18.5 |
| Results after 216 hours | | | |
| Viscosity increase (%) | 45.8 | — | 722.4 |
| TAN increase (mgKOH/g) | 4.9 | 7.8 | 11.5 |

-continued

| Example | Example 1 | Comparative Example A (commercial) | Comparative Example B (commercial) |
|---|---|---|---|
| IR oxidation (A/cm) | 72.9 | — | 66.9 |
| IR nitration (A/cm) | 13.2 | — | 27.7 |
| Insolubles (% w) | 0.03 | 42.9 | 19.5 |

A dash indicates that the sample was too thick to measure. A lower value indicates better performance in each test.

Examples 1 and A were also tested in the Ball Rust test according to ASTM D6557 to evaluate corrosion resistance. The merit rating of Examples 1 and A in the Ball Rust test is shown below; a higher rating indicates better performance. As shown below, Example 1 exhibits better corrosion resistance than comparative Example A.

| Example | Merit |
|---|---|
| 1 | 122 |
| A | 42 |

What is claimed is:

1. A gas-fuelled engine lubricating oil composition including from 0.01 to 1.3% of sulfated ash according to ASTM D-874, which comprises or is made by admixing:

(i) a major amount of oil of lubricating viscosity;

(ii) a minor amount of a detergent composition comprising at least one calcium salicylate having a total base number (TBN) in the range from 70 to 245 according ASTM D-2896;

(iii) 0 to 0.2 mass % of nitrogen, based on the mass of the oil composition, of a dispersant; and (iv) a minor amount of one or more co-additives;

with the proviso that the oil composition is substantially free of an anti-oxidant additive.

2. The gas-fuelled engine lubricating oil composition as claimed in claim 1, wherein the composition comprises less than 0.25 mass %, based on active ingredient, of anti-oxidant, based on the mass of the oil composition.

3. The gas-fuelled engine lubricating oil composition as claimed in claim 2, wherein the composition comprises less than 0.1 mass %, of anti-oxidant, based on the mass of the oil composition.

4. The gas-fuelled engine lubricating oil composition as claimed in claim 3, wherein the composition comprises less than 0.05 mass %, based on active ingredient, of anti-oxidant, based on the mass of the oil composition.

5. The gas-fuelled engine lubricating oil composition as claimed in claim 4, wherein the composition is free of anti-oxidant.

6. The gas-fuelled engine lubricating oil composition as claimed in claim 1, wherein the calcium salicylate has a TBN in the range from 95 to 195.

7. The gas-fuelled engine lubricating oil composition as claimed in claim 1, wherein the hydrocarbon backbone of the dispersant has molecular weight from 400 to 3000.

8. The gas-fuelled engine lubricating oil composition as claimed in claim 1, wherein the dispersant is substantially boron-free.

9. The gas-fuelled engine lubricating oil composition as claimed in claim 1, including from 0.01 to 1.0% of sulfated ash.

10. The gas-fuelled engine lubricating oil composition as claimed in claim 1, having a TBN of from 2 to 20.

11. The gas-fuelled engine lubricating oil composition as claimed in claim 1, including from 0 to 0.1 mass % of phosphorus, based on the mass of the oil composition.

12. A method of lubricating a gas-fuelled engine, the method comprising supplying the lubricating oil composition as claimed in claim 1 to the engine.

13. A concentrate for a gas-fuelled engine lubricating oil composition, the concentrate being substantially free from an anti-oxidant additive and comprising:

(ii) more than 40 mass %, preferably a major amount, of a detergent composition comprising at least one calcium salicylate having a TBN in the range from 70 to 245 according to ASTM D-2896;

(iii) 0 to 0.5 mass % of nitrogen, based on the mass of the oil composition, of a dispersant; and (iv) a minor amount of one or more co-additives.

14. The concentrate of claim 13, wherein the TBN of said calcium salicylate is 95 to 195 according to ASTM D-2896.

* * * * *